United States Patent [19]

Pejouhy et al.

[11] 4,086,558

[45] Apr. 25, 1978

[54] MOTOR PROTECTOR AND SYSTEM

[75] Inventors: Radi Pejouhy, Marshfield; Joseph L. McMorrow, West Bridgewater, both of Mass.

[73] Assignee: Texas Instruments Incorporated, Dallas, Tex.

[21] Appl. No.: 656,459

[22] Filed: Feb. 9, 1976

[51] Int. Cl.[2] ..... H01H 37/52

[52] U.S. Cl. ..... 337/102; 337/110; 337/112; 337/377; 337/380; 318/471

[58] Field of Search ..... 337/2, 3, 36, 54, 89, 337/110, 102, 104, 105, 107, 112, 333, 365, 367, 377, 380; 310/68 C; 318/471, 472, 473; 200/144 R, 147 R

[56] References Cited

U.S. PATENT DOCUMENTS

| | | | |
|---|---|---|---|
| 2,892,910 | 6/1959 | Diebold | 337/89 |
| 2,951,924 | 9/1960 | Schultz | 337/281 |
| 3,243,679 | 3/1966 | Enemark | 318/471 X |
| 3,474,372 | 10/1969 | Davenport et al. | 337/112 X |

*Primary Examiner*—Robert J. Hickey
*Attorney, Agent, or Firm*—John A. Haug; James P. McAndrews

[57] ABSTRACT

A motor protector characterized by low cost, by improved service life and by improved cycling properties has a bimetallic element mounted in a metal housing to move a first contact along a selected axis to engage and disengage a complementary contact in response to changes in element temperature. An electrical resistance heater coil, preferably with less than one full coil convolution, is oriented and secured externally of the housing so that the axis of the magnetic field established by the heater coil is coincident with the axis of movement of the first contact. The properties of the heater are selected relative to the thermal mass of the protector so that, when the heater and the protector contacts are arranged in series with motor windings, the external heater is adapted to heat the entire thermal mass of the protector to a sufficient temperature in response to the occurrence of selected overload or fault currents in the motor windings to actuate the bimetallic element to open the winding circuit before excessive overheating of the motor windings can take place. In this arrangement, the heater orientation avoids magnetic deflection of arcs occurring during opening of the protector circuit, thereby improving service life, and the heating of the entire thermal mass of the protector in opening the protector circuit retards subsequent reclosing of the circuit, thereby improving cycling properties of the protector. Preferably, the protector is mounted in a common housing with motor starter means to utilize common terminals with the stater means. Also, where the protector is used to protect a motor in a sealed refrigeration compressor system, the protector is preferably mounted in spaced but closely adjacent relation to the compressor shell, thereby to avoid reduction in cycling time by avoiding draining of heat from the protector into the shell and thereby to avoid opening of the protector when the shell is heated during normal compressor operation while permitting heat transfer from the shell during the occurrence of a sustained fault condition in the motor to further improve protector cycling time.

10 Claims, 6 Drawing Figures

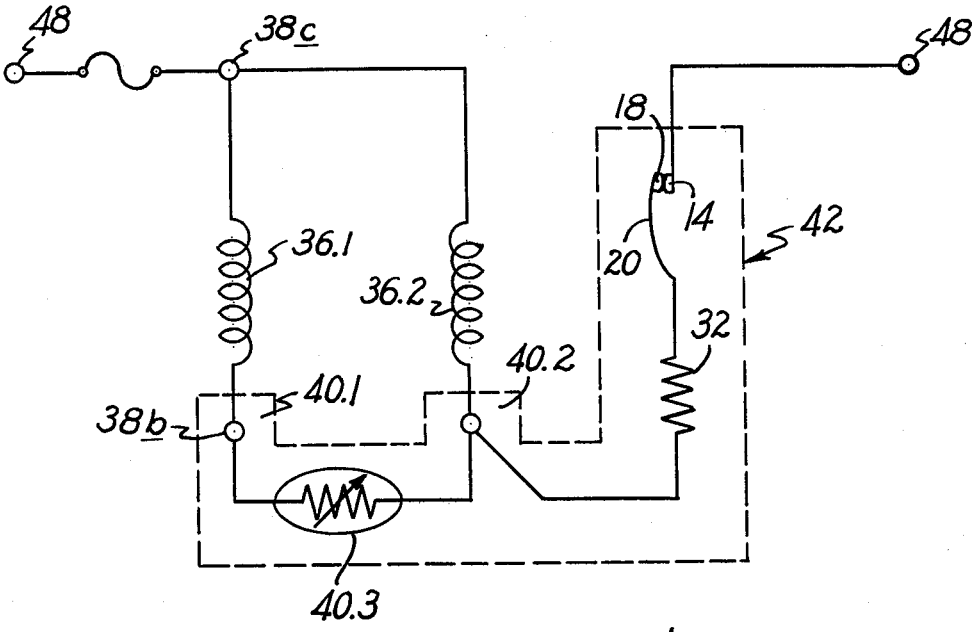
Fig. 5.
Fig. 6.
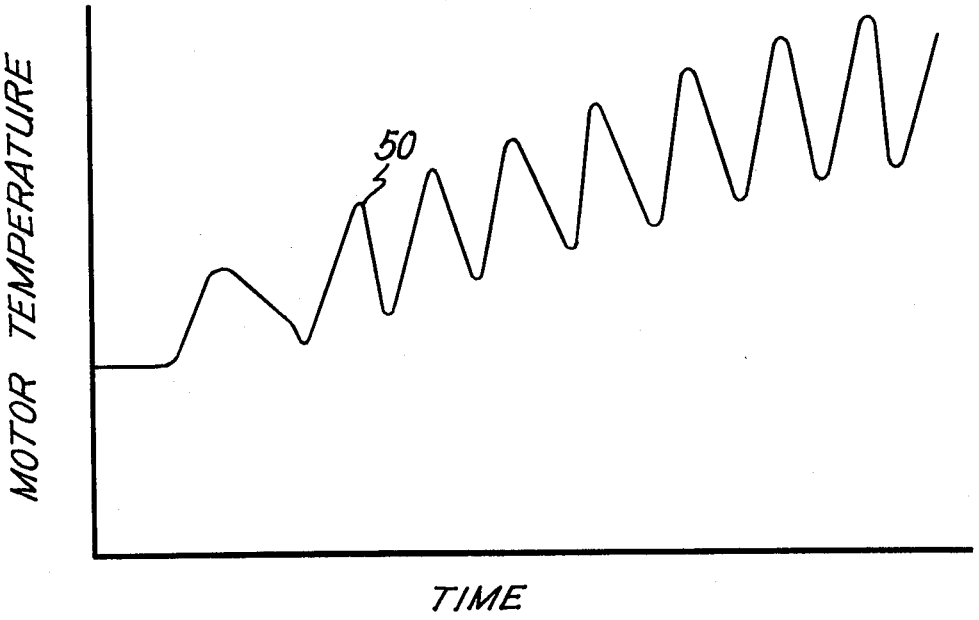

MOTOR PROTECTOR AND SYSTEM

In some motor protector systems, a protective device is disposed directly within a motor winding to be directly responsive to increases in the winding temperature, thereby to open the winding circuit when a fault condition occurs before excessive overheating of the winding can take place. The effectiveness of these known protector systems is heavily dependent upon proper positioning of the protective device in efficient heat transfer relation to the winding.

In other protective systems, where consistent mounting of the protector in efficient heat-transfer relation to the winding cannot be assured, or where greater anticipation of overheating of the motor is desired, the thermally responsive element in the protector is provided with electrical resistance heater properties, or a separate resistance heater is incorporated in the device. These heater means are arranged in series with the motor windings to be responsive to the occurrence of selected overload or fault currents in the windings for heating thermally responsive components of the protector to open the winding circuits before excessive winding heating can take place. Protection systems of this latter type have tended to be expensive for several reasons. For example, the protectors to be used in protecting each size and type of motor have each required incorporation of heater means matched to the characteristics of each motor. Accordingly, the quantities of each of the different motor protectors required to serve the market are relatively small so that mass production of the protectors by automated facilities are not warranted and the individual protector costs are relatively high. Further, after the thermally responsive elements in the protectors have been actuated to open a winding circuit, the thermal mass of the thermally responsive element is small relative to the other thermal mass of the protector, resulting in rapid cooling of the element and reclosing of the circuit. Accordingly, such motor protectors tend to cycle rapidly during the occurrence of a sustained motor fault condition, thereby resulting in significant reduction in protector service life. It has been difficult to overcome these cycling problems in protectors having internal heater means, particularly where small protector devices or protectors for use with low motor winding currents have been involved. Some known protector devices have utilized externally wound wire heaters in attempts to improve protector cycling properties but such known protectors have been subject to undesirable magnetic effects which have deleteriously reduced protector service lines in other ways.

It is an object of this invention to provide a novel and improved motor protector device; to provide such an improved protector having a structure which is adapted to be mass produced at low cost; to provide such a mass producible protector structure which is readily adapted for use in protecting motors with widely varying characteristics; to provide such a protector which is promptly responsive to the occurrence of overload or fault currents in a motor winding circuit; to provide such a protector which displays improved cycle time and improved service life; to provide such a protector which is particularly useful in protecting motors with relatively low motor currents; and to provide such a protector which is of simple, rugged construction. It is also an object of this invention to provide such an improved motor protector which is easily accommodated in a common housing with motor starting means to utilize common terminals with the starting means and to provide a motor protection system wherein the protector is used to protect a motor in a sealed refrigeration compressor and wherein the system permits the protector to display further improved cycle times and service life.

Other objects, advantages and details of the novel and improved motor protector and protection system of this invention appear in the following detailed description of preferred embodiments of the invention, the detailed description referring to the drawings in which:

FIG. 5 is a schematic view of the motor protector of this invention as utilized in the motor protector system of FIG. 4; and FIG. 6 is a graph illustrating cycling characteristics of the motor protector system of this invention.

Figure 1:
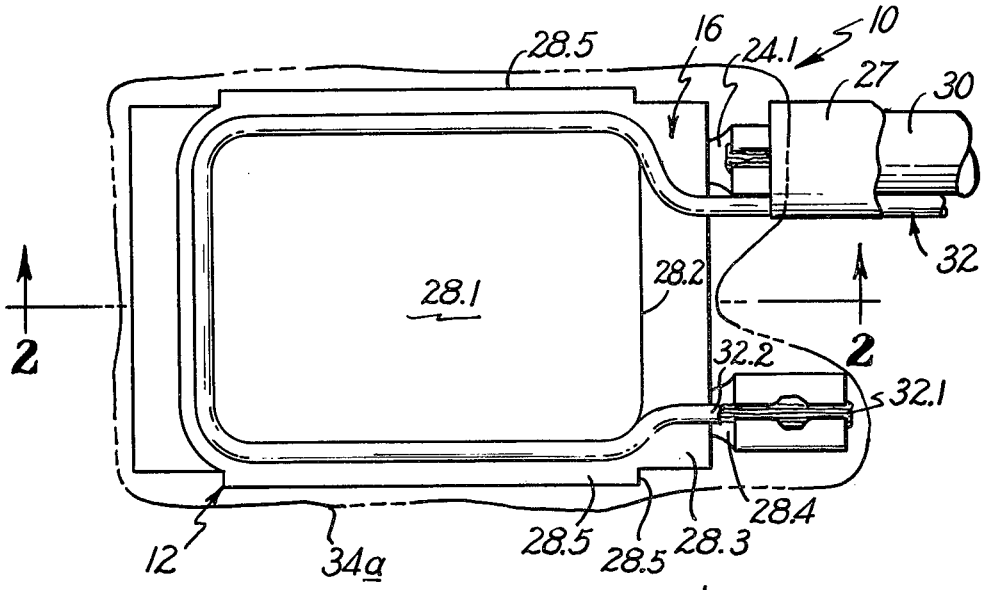
FIG. 1 is a plan view of the motor protector provided by this invention.
Figure 2:
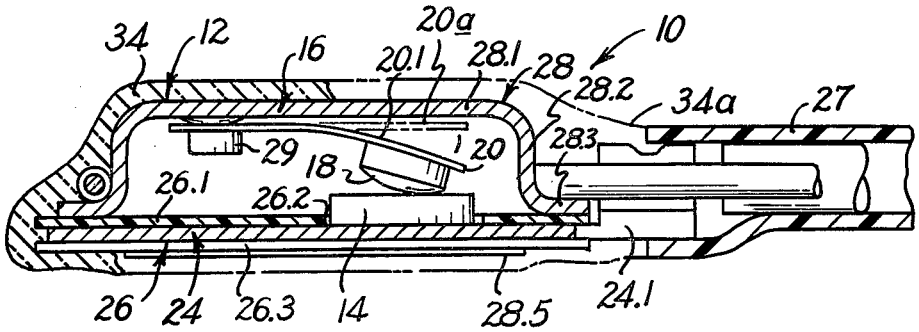
FIG. 2 is a section view along line 2—2 of FIG. 1.
Figure 3:
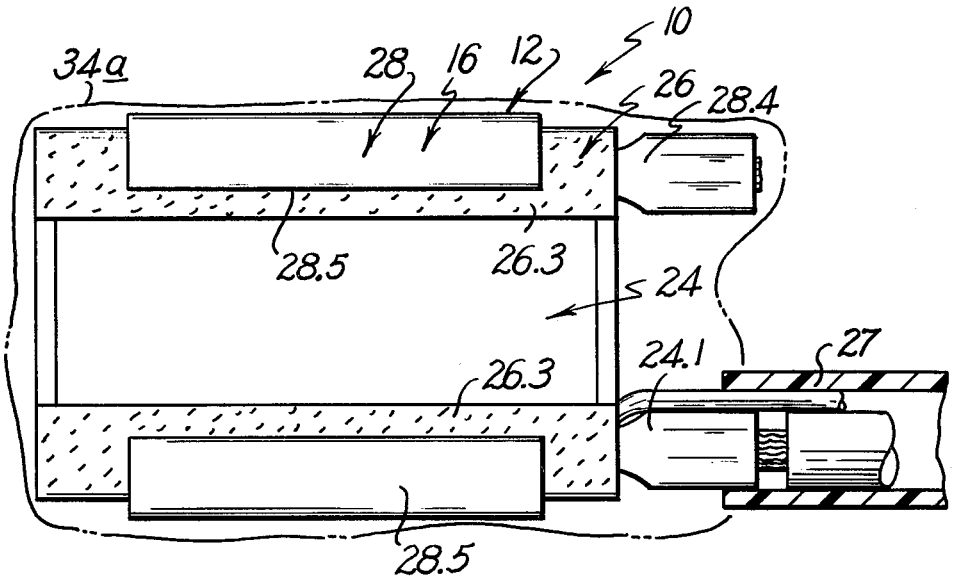
FIG. 3 is a bottom view of the motor protector of FIG. 1.

Referring to the drawings, 10 in FIGS. 1–3 indicates the novel and improved motor protector device of this invention which is shown to include a basic motor protector assembly 12 incorporating a fixed electrical contact 14 mounted in a metal housing 16 and a complementary electrical contact 18 movable along an axis (indicated at 22 in FIG. 2) by a thermostatic bimetallic element 20 to engage and disengage the first contact 14 in response to changes in the temperature of the thermostatic element. In a preferred embodiment of this invention, the basic protector assembly 12 is particularly adapted to be mass produced at very low cost and the thermal mass of the housing and electrical contacts embodied in the assembly is large relative to the thermal mass of the thermostatic element in the assembly.

Typically, for example, the basic motor protector assembly 12 corresponds to that shown in U.S. Pat. No. 3,430,177 issued on Feb. 25, 1969 to R. T. Audette. That is, as is illustrated in FIGS. 1–3, the housing 16 of the assembly 12 preferably comprises a metal plate 24 having an integral terminal sleeve 24.1 at one end of the plate which is adapted to receive and to be crimped around an electrical lead end. The first contact 14 is welded to the plate 24 as shown in FIG. 2. A sheet 26 of gasket material has a main portion 26.1 fitted over the plate, has an opening 26.2 therein fitted around the contact 14, and has edges 26.3 extending around respective lateral edges of the plate 24. The housing 16 further includes a can member 28 having a bottom 28.1, side walls 28.2, a flange 28.3 extending from the side wall, an integral, crimpable sleeve terminal 28.4 extending from the flange at one end of the can, and a pair of tabs 28.5 extending from the flange around respective edges 26.3 of the gasket and around the lateral edges of the plate 24 to grip and secure the plate 24 in sealed, electrically insulated relation to the can. The thermostatic element 20 is welded to the can bottom 28.1 by means of a welding slug 29 to extend in cantilever relation from the can bottom. The movable, complementary contact 18 is welded to the distal end of the element 20 as shown in FIG. 2. As will be understood, the thermostatic element 20 is formed of two layers of metal or different coefficients of thermal expansion and has a dished or non-developable portion 20.1 intermediate its ends. With this construction, the element 20 normally holds the movable contact 18 in engagement with the fixed contact 14 to close a circuit between the terminals 24.1 and 28.4. However, when the element is heated to a selected temperature, the element moves, with snap-over-center action of the dished portion thereof, to the disposition indicated by the broken line **20*a* in FIG. 2 thereby to disengage the contacts to open the noted circuit. Typically, the materials of the thermostatic element are selected to provide the element with a desired electrical resistivity so that the element is heated to a selected extent by the flow of electrical current through the element. As the basic assembly 12 is conventional, it is not further described herein and it will be understood that the element 20 is adapted to move with snap-action to disengage the contacts when the element is heated to a first selected temperature and is then adapted to move with snap-action to reengage the contacts when the element subsequently cools to a second, relatively lower, element temperature. Preferably, in a typical embodiment of this invention, the basic protector assembly 12 is about 0.750 inches long, 0.375 inches wide and about 0.187 inches thick. Further, the thermostatic element 20** typically has a mass of approximately 0.05 grams whereas the combined mass of the housing, contacts and other metal components of the assembly is typically on the order of 1.4 grams.

In accordance with this invention, a first, insulated electrical lead wire 30 has an end portion stripped of its insulation and crimped within the plate terminal 24.1. An additional wire 32 having a core 32.1 of a metal of selected relatively high electrical resistivity and having an insulating coating 32.2 is positioned adjacent to the lead wire 30 and is extended around an external surface of the basic protector assembly 12 to serve as an electrical heater for the basic assembly. The heater wire 32 is preferably arranged in the form of a heater coil embodying less than one full coil convolution as shown in FIG. 1 and in accordance with this invention, the coil formed by the heater wire 32 is oriented relative to the axis of movement 22 of the movable contact 18 so that the central axis of the magnetic field established by the heater coil when electrical current is directed through the coil is parallel to and preferably substantially coincident with the axis of contact movement 22. That is, where the axis of the magnetic field formed by the heater coil is coaxial with the coil, the coil is oriented also to be coaxial with the axis of movement 22 of the contact 18. Preferably, as shown in FIG. 1, the heater wire is disposed in close heat transfer relation to the housing can 28 extending around three side walls 28.2 in arrangement with the flange 28.3 and one end of the heater wire is stripped of its insulation and is crimped within the can terminal 28.4. Preferably a tube of heat shrunken irradiated polyvinylchloride tubing or the like is disposed around the lead wire 30 and the heater wire 32 at the location of the terminal 24.1 for securing the heater wire in the desired heat-transfer relation to the housing can 28. Preferably, also, the resulting structure is then coated with a heat-conducting, dielectric cement indicated at 34 in FIG. 2 for further securing the heater wire 32 in a desired heat-transfer relationship to the housing can 28. (The coating 34 is indicated in FIGS. 1 and 3 only by the broken line **34*a* for clarity of illustration.) Preferably, for example, the coating 34 is formed of a conventional saureisen cement or the like which is adapted to be cured in air to form a hard, adherent, ceramic-like coating displaying excellent heat conductivity and electrical insulating properties at temperatures up to over 1000° C. Desirably, about 0.4 grams of the coating material 34 are used to enhance the thermal mass of the protector 10** of this invention.

In this arrangement of the basic assembly 12, the heater 32, and the coating 34 as described, an electrical circuit is provided which extends from the lead wire 30, through the plate 24, the contacts 14 and 18, the thermally responsive element 20 and the can 28 to the heater wire 32. In accordance with this invention, the material of the heater 32 is selected relative to the total thermal mass of the protector 10 and to the thermal actuation temperature of the element 20 so that, when a selected level of electrical current is directed through the noted circuit, the heating properties of the heater 32 cooperate with the heating effect achieved by directing the noted current through the element 20 to heat the entire thermal mass of the protector 10 to a sufficient temperature to actuate the element 20 to open the protector contacts within a desired period of time. That is, although the basic protector assembly 12 can be standardized for use in manufacture of motor protectors having widely differing thermal properties and is therefore adapted for mass production by use of automated equipment to significantly reduce motor protector cost, the basic motor protector assembly is easily adapted by the incorporation of an external heater 32 of desired heating properties, thereby to adapt the motor protector to match the thermal and current characteristics of a wide variety of motors to be protected. Preferably, the ratio of the thermal mass of the protector as a whole relative to thermal mass of the element 20 used in the protector is within the range from about 1:1 to about 40:1. Preferably, also the external heater 32 used in the protector is adapted to cooperate with the resistance provided by the element 20 to actuate the element 20 to open protector contacts within from 1 to 15 seconds in response to selected current levels in the protector circuit. Typically, for example, where the basic motor protector assembly has the construction and proportions as described above by way of example, the total thermal mass of the protector 10 is about 1.8 grams as compared to the thermal mass of 0.05 grams of the thermally responsive element 20. Typically, also the element 20 provides approximately 0.004 ohms of resistance and has an actuation temperature of about 150° C. for snapping to open circuit position and a reclosing temperature of about 69° C. for returning to closed circuit position. Such a typical protector provided by this invention is provided with any of various heater wires 32 as shown in the following table to provide the protector with actuating times at selected current levels as shown in the following table:

TABLE I

| Example | Eff. Resistance (Ohms) | Actuator Current (Amps) | First Cycle Trip Time (Seconds) |
|---|---|---|---|
| #31 Gage | 1.1 | 3.6 | 10 |
| #25.5 Gage | 0.23 | 9.0 | 10 |
| #23 Gage | 0.13 | 11.0 | 10 |
| #22.5 Gage | 0.11 | 15.0 | 10 |

Figure 4:
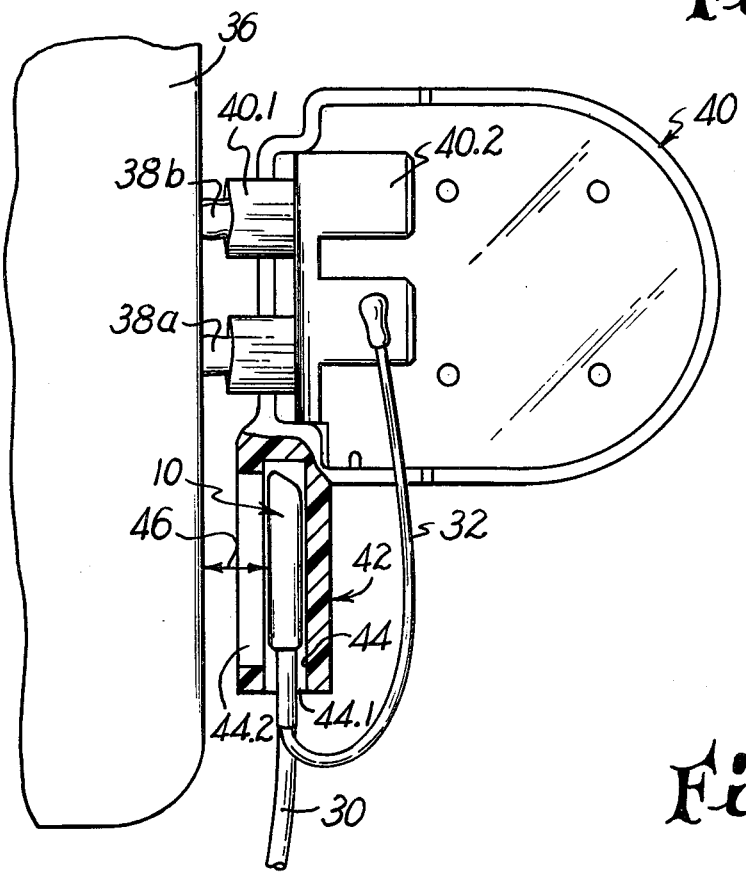
FIG. 4 is a plan view, partially in section, of the combined motor starter and motor protector of this invention diagrammatically illustrating use of the motor protector in a motor protector system.

Accordingly, the motor protector is particularly adapted for use in protecting electrical motors where consistent mounting of the protector in efficient heat-transfer relation to the motor cannot be assured. For example, as is illustrated in FIGS. 4 and 5, the protector 10 is particularly adapted for use in protecting an electrical motor used in a sealed refrigeration compressor system. That is, as is shown in FIG. 4, in such a compressor system, a conventional electrical motor and a refrigeration compressor are enclosed within a metal compressor shell indicated at 36 in FIG. 4. Electrical connections are conventionally made to the motor windings by means of pins 38, usually three in number, which extend through the shell 36 in sealed relation to the shell. Conventional motor starter means such as are indicated at 40 in FIG. 4 are then mounted on appropriate pins 38 for use in starting the compressor motor in a conventional way. Typically, for example, the motor starter means 40 comprises a generally conventional starter device such as is shown in U.S. Pat. No. 3,921,117 issued to Robert E. Blaha on Nov. 18, 1975.

In accordance with this invention, however, the housing of the otherwise conventional starter means 40 is preferably modified as illustrated in FIG. 4 to incorporate an extension 42 providing a well 44 open at one end 44.1 to receive the motor protector 10, the extension well preferably having window 44.2 as shown. The heater wire 32 of the protector 10 is then soldered or otherwise secured to a selected terminal of the starter means 40 as shown and the lead wire 30 of the protector is adapted to be connected to one line of a selected power source. In this arrangement, mounting of the starter means 40 on two of the compressor pins 38*a*, 38*b* also mounts the protector 10 in a desired spaced, but closely adjacent relationship indicated at 46 in FIG. 4. Typically, the motor protector is spaced at a spacing 46 of about 0.25 inches. A second line for the noted power source is then connected to an additional pin 38*c* (shown in FIG. 5) on the compressor 36.

In this arrangement as is shown in FIG. 5, terminals 40.1 and 40.2 of the starter are connected to the start winding 36.1 and the main winding 36.2 of the compressor motor through the pins 38*a* and 38*b*, thereby to dispose a variable starting resistor 40.3 in series with the start winding across the main winding. The compressor pin 38*c* connects the opposite ends of the windings to the power line 48. The external heater 32, the protector contacts 14 and 18, and the resistive thermally responsive element 20 of the protector are then connected to the terminal 40.2 and to the power line 48 as shown, thereby to position the protector circuit in series with the two motor windings or protecting the motor windings against overheating when overload or fault currents appear in the windings. It will be understood that, with other conventional terminal arrangements, the motor protector 10 could be connected at the opposite end of the motor windings.

When the motor protector 10 of this invention is used in the protector system illustrated in FIGS. 4 and 5, closing of a line switch (not shown) is effective to energize the motor windings, the variable resistor 40.3 of the motor starter means 40 then being effective in the conventional manner to effectively deenergize the start winding after a selected period of time. The circuit of the motor protector 10 is adapted to carry the initial motor winding currents and the normal steady state running current of the main motor winding as will be understood. That is, the initial and normal steady state motor currents do not generate sufficient heat in the resistance components of the motor protector to elevate the thermally responsive element 20 of the protector to its actuation temperature. Further, when the compressor shell 36 heats up during normal operation of the compressor, the spacing of the protector 10 from the shell as shown in FIG. 4 prevents such heat transfer from the shell as would cause the element 20 of the protector to reach its actuation temperature.

However, on the occurrence of an overload current in one of the motor windings, or in both of the windings during motor starting, which reflects the occurrence of a motor fault condition such as a locked rotor, the heater 32 cooperates with the heating effect of the element 20 to heat the entire thermal mass of the protector 10 to a sufficient temperature to actuate the thermally responsive element 20 to open the protector contacts and the motor winding circuit to prevent excessive overheating of the motor winding.On opening of the winding circuit by the protector, the protector heater means are also deenergized and, accordingly, the element 20 in the protector begins to cool. However, where the heater 32 utilized in the protector of this invention is arranged to heat the entire thermal mass of the protector in actuating the protector, heat dissipation for the element 20 in the protector occurs very slowly. As a result, the protector 10 of this invention, although adapted to open the winding circuit promptly on the occurrence of a motor fault condition, is also adapted to retain the winding circuit in open condition for a relatively long period of time. Typically for example, the motor protector 10 is adapted to open the main motor winding circuit in approximately 10 seconds on the occurrence of a locked rotor current in the main motor winding and is then adapted to retain the winding circuit in open condition for about 80 seconds until sufficient heat has been dissipated from the relatively large thermal mass of the protector to permit the element 20 to cool to its reset temperature. Then, if the motor fault condition is still maintained, the heater 32 is again effective to reopen the motor circuit after a slightly shorter period of time. Further, the heat provided to the protector by the heater tends to retain the motor winding circuit open for a slightly longer period. Accordingly, as is indicated by the curve 50 in FIG. 6, the motor protector 10 cycles during the occurrence of a sustained fault condition with slightly reducing circuit opening times and slightly increasing closing times until motor temperature stabilizes as a motor temperature which is elevated above normal motor temperature but which is below a temperature at which the motor winding would be damaged. Upon removal of this fault condition, the motor protector 10 returns the motor to operating condition. Further, where the motor protector 10 is disposed in spaced but closely adjacent relation to the compressor shell 36 as shown in FIG. 4, the compressor shell can be heated to a temperature above normal during occurrence of a sustained fault condition and heat-transfer from the shell to the protector 10 through the window 44.2 is effective to further increase the cycle time of the protector 10.

In this way, the protector of this invention is provided with a basic structure which is adapted for mass production at low cost. However, the attachment of selected external heater 32 to the basic structure permits application of the protector to motors of a wide variety of thermal and electrical characteristics. Further, the use of this external heater on the protector provides the protector with a long thermal cycling time so that the protector has a long service life even when subjected to sustained motor fault conditions. On the other hand, the orientation of the external heater is such that any magnetic field established by the heater does not tend to deflect arcs which occur during opening of the protector contacts. In this regard it will be appreciated that if use of the heater created a magnetic field which tended to deflect such arcs, such arcs would tend to strike the thermally responsive element 20 within the protector and would tend to rapidly alter the thermal response characteristics of the element to result in reduced protector life. Note that where the protector is spaced from the compressor shell 36, the shell does not tend to drain heat from the protector during cycling thereof and therefore does not tend to reduce protector cycling time. However, where shell temperature is gradually elevated to a sufficient level during a sustained fault condition, heat transfer from the shell to the protector can occur and can further improve protector cycle time.

It should be understood that although preferred embodiments of this invention have been described for illustrating the invention, the invention includes all modifications and equivalents of the disclosed embodiments falling within the scope of the appended claims.

We claim:

1. A motor protector comprising a metal housing, a first contact mounted within the housing, a complementary contact, a thermally responsive bimetallic element mounted within the housing for moving the complementary contact along a selected axis to engage and disengage the first contact in response to changes in temperature of the thermally responsive element, and electrical resistance heater coil means mounted externally of the housing in heat-transfer relation thereto for heating the thermally-responsive element to a sufficient temperature to disengage the complementary contact from the first contact, said heater coil means being oriented so that the axis of the magnetic field established by current flow in the heater coil means is substantially coincident with said axis of movement of the complementary contact.

2. A motor protector as set forth in claim 1 wherein said heater coil means embodies less than one full coil convolution for limiting the magnetic field established by current flow through the heater coil means.

3. A motor protector comprising a first metal housing part having a bottom and having a side wall upstanding from said bottom, a second metal housing part secured in electrically insulated relation to the first housing part for forming an enclosure, a complementary contact, a thermally responsive bimetallic element mounted within the housing enclosure for moving the complementary contact along a selected axis between the bottom of the first housing part and the second housing part to engage and disengage the first contact in response to changes in temperature of the thermally responsive element, and electrical resistance heater coil means mounted externally of said housing enclosure, said heater coil means extending around said side wall of said first housing part in heat transfer relation thereto and in surrounding relation to said axis of movement of the complementary contact so that the axis of the magnetic field established by electrical current flow in said heater coil means is substantially coincident with said axis of movement of the complementary contact.

4. A motor protector as set forth in claim 3 wherein the ratio of the total thermal mass of the protector to the thermal mass of the thermally responsive element is in the range from 1:1 to 40:1 and wherein said heater coil means is adapted to heat said total thermal mass to a sufficient temperature to move the thermally responsive element to disengage said contacts within one to twenty seconds in response to a current of from 3 to 15 amperes being directed through said heater means.

5. A motor protector comprising a first metal housing part having a bottom and having a side wall upstanding from said bottom extending around the bottom, a second metal housing part secured in electrically insulated relation to the first housing part over said side wall for forming an enclosure between said parts, a first contact mounted on said second housing part within said enclosure, a complementary contact, a thermally responsive bimetallic element having a dished portion therein mounted at one end thereof on said bottom of said first housing to extend in cantilever relation therefrom for supporting said complementary contact at the distal end of the bimetallic element, said thermally responsive element normally holding the complementary contact in engagement with the first contact to close an electrical circuit between said housing parts, said thermally responsive element being adapted to move with snap-action when heated to a first elevated temperature for moving the complementary contact along a selected axis between the bottom of the first housing part and the second housing part to disengage the contacts for opening said circuit and being adapted to move with snap-action when subsequently cooled to a relatively lesser temperature for moving the complementary contact along said axis to reengage said contacts for reclosing said circuit, and electrical heater coil means mounted externally of said housing in heat-transfer relation thereto, said heater coil means extending around said side wall of said first housing part in surrounding relation to said axis of movement of the complementary contact so that the axis of the magnetic field established by electrical current flow in said heater coil means is substantially coincident with said axis of movement of the complementary contact.

6. A motor protector as set forth in claim 5 wherein said heater coil means is connected in series relation to said circuit.

7. A motor protector as set forth in claim 6 wherein each of said housing parts has terminal means thereon, wherein a lead wire is secured to one of said terminal means, and wherein said heater coil means comprises less than one full coil convolution of an insulated heater wire electrically connected to the other of said terminal means to extend substantially around said side wall of said first housing part.

8. A motor protector as set forth in claim 7 having said heater wire secured to said first housing part by a thermally conducting cement.

9. A motor protector as set forth in claim 8 wherein said cement covers said heater wire and said housing for providing said protector with a selected thermal mass.

10. In combination with a sealed refrigerator compressor system having a compressor and a motor mounted in sealed relation within a metal compressor shell, said motor having start and main windings therein, a motor protector comprising a metal housing, a first contact mounted within the housing, a complementary contact, a thermally responsive bimetallic element mounted within the housing for moving the complementary contact along a selected axis to engage and disengage the first contact in response to changes in temperature of the thermally responsive element for closing and opening a selected circuit between said contacts, means connecting said circuit in series with said motor windings, and electrical resistance heater coil means mounted externally of the housing in heat-transfer relation thereto for heating the thermally-responsive element to a sufficient temperature to disengage said contacts to open said circuit in response to flow of a selected current through said heater means, said heater coil means being oriented so that the axis of the magnetic field established by said selected current flow in the heater coil means is substantially coincident with said axis of movement of the complementary contact, said heater means being arranged in series with said circuit so that said selected current is directed through said heater means on the occurrence of a fault condition in said motor, said protector being mounted in spaced, closely adjacent relation to said compressor shell to prevent draining of heat from said protector into said shell, and to prevent disengagement of the protector contacts in response to heat-transfer from the shell during normal compressor operation while permitting heat-transfer from the shell to the protector during the occurrence of a sustained fault condition in said motor to enhance cycle time of the protector.

* * * * *